United States Patent [19]

Pemberton

[11] Patent Number: 4,907,832

[45] Date of Patent: Mar. 13, 1990

[54] SECONDARY LOCKING MECHANISM

[75] Inventor: Whitley Pemberton, Davis, Ill.

[73] Assignee: Truth Incorporated, Owatonna, Minn.

[21] Appl. No.: 237,956

[22] Filed: Aug. 29, 1988

[51] Int. Cl.[4] ..... E05C 3/00

[52] U.S. Cl. ..... 292/228; 292/DIG. 46; 292/DIG. 15; 292/152; 292/238

[58] Field of Search ..... 292/219, 228, 209, 230, 292/238, 338, DIG. 15, DIG. 46, DIG. 47

[56] References Cited

U.S. PATENT DOCUMENTS

| | | | |
|---|---|---|---|
| 33,596 | 10/1861 | Morrison . | |
| 431,897 | 7/1890 | Lairamore . | |
| 544,730 | 8/1895 | Kennedy . | |
| 693,568 | 2/1902 | Rosentreter . | |
| 863,610 | 8/1907 | Keith . | |
| 1,445,959 | 2/1923 | Knopke | 292/230 X |
| 1,473,834 | 11/1923 | Sasgen . | |
| 1,601,051 | 9/1926 | Wilbert | 292/230 |
| 1,687,517 | 10/1928 | Sasgen . | |
| 1,915,795 | 6/1933 | MacMillan . | |
| 2,073,024 | 3/1937 | Potter | 292/338 |
| 2,202,952 | 6/1940 | Hayes | 292/238 |
| 2,217,996 | 10/1940 | Sasgen | 292/338 |
| 2,612,398 | 9/1952 | Miller | 292/230 |
| 3,352,586 | 11/1967 | Hakanson | 292/DIG. 46 X |
| 3,831,989 | 8/1974 | Gurzenda | 292/338 |
| 4,274,666 | 6/1981 | Peck | 292/257 |
| 4,407,539 | 10/1983 | Asp | 292/338 |

*Primary Examiner*—Richard E. Moore

*Attorney, Agent, or Firm*—Wood, Dalton, Phillips, Mason & Rowe

[57] ABSTRACT

A secondary locking mechanism having a lock mountable to a sliding closure, such as a sliding window or sliding patio door, and a stop block mountable to a frame member which mounts the sliding closure. The lock has a pivotable stop arm which is spring-retained in an inactive position wherein a foot of the stop arm travels in a path of movement along with the sliding closure which is out of interfering relation with the stop block and an active position wherein the foot of the stop arm is positioned to engage beneath an inclined end of the stop block to prevent further movement of the sliding closure in a direction toward the stop block. One or more stop blocks can be mounted in various positions on the frame member to assist in locking the sliding closure in a fully-closed position and to prevent further opening movement of the sliding closure when it is in a partially-open vent position. In a patio door, the lock is mounted adjacent the bottom of a vertical edge of the sliding door and the stop block constitutes a floor stop in the form of a plate mounted to the sill of the patio door.

9 Claims, 2 Drawing Sheets

SECONDARY LOCKING MECHANISM

DESCRIPTION

1. Field of the Invention

This invention pertains to a secondary locking mechanism for a sliding closure, such as a sliding window or sliding patio door, wherein the closure has primary locking mechanism and it is desired to provide secondary locking mechanism for increased security and to also enable use of the secondary locking mechanism for establishing one or more partially-open vent positions for the sliding closure.

2. Background of the Invention

Various types of secondary locking mechanisms for use with sliding closures are known in the art. Some of these structures are quite similar to pivoted stop devices usable with swingable closures, such as a door, for holding the door in either fully or partially-open positions.

A structure of the type referred to above has a mounting member attachable to a closure and a foot pivotally mounted to the mounting member for movement between an inactive position and an active position. In the active position, a rubber element can engage a portion of the floor beneath a swinging door or a portion of the frame of a sliding closure, such as the sill of a sliding door. It is also known to have an end of the foot provided with grit, rather than a rubber element, to provide increased friction for improved holding under certain conditions.

There are drawbacks to the use of a rubber element for the foot because of the lack of holding power if the engaged sill of a sliding patio door were wet or frosty and the use of grit can mar the surface with which it comes in contact.

SUMMARY OF THE INVENTION

A primary feature of the invention is to provide a new and improved secondary locking mechanism for a sliding closure, such as a sliding patio door.

An object of the invention is to provide a secondary locking mechanism for a sliding closure having two primary components, with one component being a lock mountable to the sliding closure and the other component being a stop block mountable to a frame member for the sliding closure. The lock has a mounting bracket which pivotally mounts a stop arm having two arm segments generally at right angles to each other, with one arm segment defining a latch element for releasable connection to a retention spring mounted on the mounting bracket and the other arm segment defining a foot. The stop block mountable to the frame has an end at a slight incline. The stop arm has an inactive position wherein one arm segment, functioning as the latch element, is engaged by the spring to have the other arm segment, functioning as the foot, extend outwardly from the mounting bracket generally at a right angle. Pivoting of the stop arm to an active position with release thereof from the retention spring pivots the foot to an angle whereby a free end thereof can engage under the inclined end of the stop block.

In a particular utilization of the secondary locking mechanism for a sliding patio door, the secondary locking mechanism set forth in the preceding paragraph has the mounting bracket mounted to a vertical edge of the sliding door near the bottom thereof and the stop block is a floor stop in the form of a plate attachable to the sill. In the inactive position, the foot extends outwardly from the mounting bracket in a generally horizontal plane at a level above the floor stop and, in an active position, the foot is pivoted to a downwardly-inclined position wherein the free en thereof is at a level to move beneath the inclined end of the floor stop.

Another object of the invention is to provide a secondary locking mechanism as defined in the preceding paragraphs wherein the stop block can be mounted in any one of several different locations on the frame member for the sliding closure whereby the secondary locking mechanism can provide either increased security for the sliding closure when in closed locked position or provide for locking of the sliding closure against further opening from one or more partially-open vent positions.

It is within the scope of the invention to form the stop block from a shaped section of the frame member, rather than use a separate element.

DESCRIPTION OF THE PREFERRED EMBODIMENT

Figure 3:
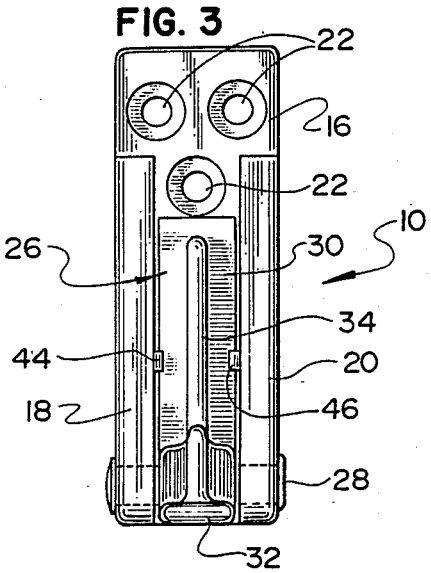
FIG. 3 is a side elevation of the structure shown in FIG. 1 looking toward the right side thereof.
Figure 4:
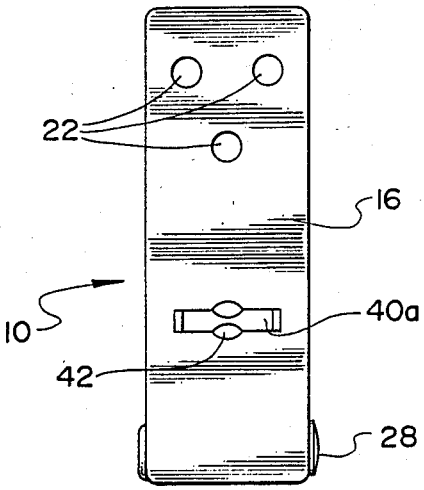
FIG. 4 is a side view of the structure shown in FIG. 1 looking toward the left side thereof.
Figure 5:
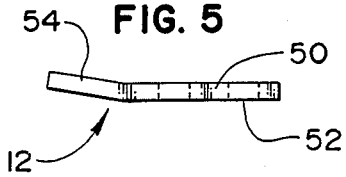
FIG. 5 is a front elevation of the stop block of the secondary locking mechanism.
Figure 6:
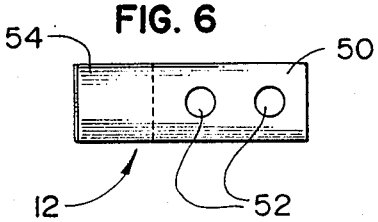
FIG. 6 is a plan view of the structure shown in FIG. 5.
Figure 7:
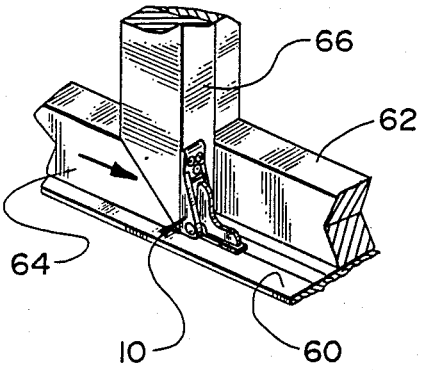
FIG. 7 is a fragmentary perspective view showing the lock of the secondary locking mechanism associated with a sliding patio door wherein the sliding door moves in the direction of the arrow in opening movement.
Figure 8:
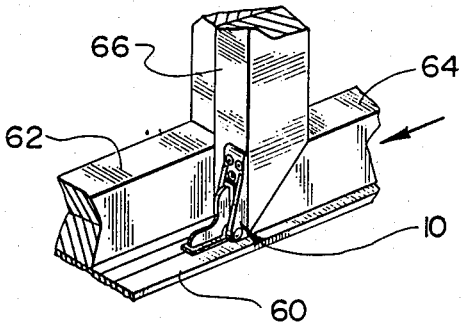
FIG. 8 is a fragmentary perspective view of a patio door wherein the sliding door moves in the direction of the arrow in its opening movement.

The secondary locking mechanism has two basic components, with the first component being a lock, indicated generally at 10 in FIGS. 1–4 and the second component being a stop block (floor stop), indicated generally at 12, in FIGS. 5 and 6.

The lock 10 has a mounting bracket having a base plate 16, with a pair of spaced flanges 18 and 20 extending therefrom. A series of fastener-receiving openings 22 are formed in the back plate near the upper end thereof for mounting of the mounting bracket in a manner to be described.

The lower ends of the mounting bracket flanges 18 and 20 are provided with aligned apertures for receiving means for pivotally mounting a stop arm, indicated generally at 26. This means is in the form of a rivet 28 extended through the apertures and also through an aperture at an apex of the stop arm 26. The stop arm is generally L-shaped with a pair of arm segments 30 and 32 extending at right angles to each other and having the apex at the juncture thereof.

Figure 2:
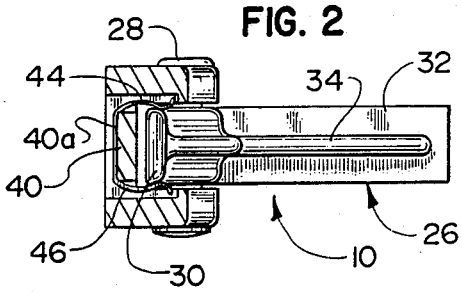
FIG. 2 is a sectional view, taken generally along the line 2—2 in FIG. 1.

The stop arm 26, as seen particularly in FIGS. 2 and 3, is formed of generally flat material and with an integral central strengthening rib 34 extending continuously lengthwise thereof.

The arm segment 30 forms a latch element for coaction with a generally U-shaped retention spring, as seen in FIGS. 2 and 4. The retention spring has a base 40*a* fitted into a recess formed in the base plate 16 of the mounting bracket and secured thereto by staking, as shown at 42. The retention spring 40 has a pair of spaced curved arms 44 and 46 which receive latch element arm segment 30 therebetween to releasably retain the stop arm 26 in an inactive position. This coaction is seen in FIGS. 2 and 3.

Figure 1:
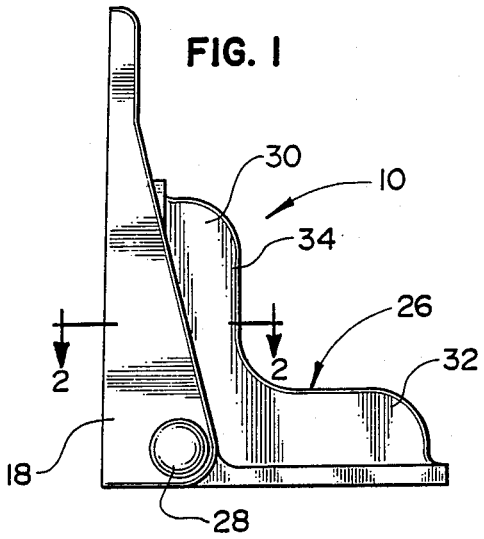
FIG. 1 is a front elevation of the lock of the secondary locking mechanism.

The stop arm 26 is shown in its inactive position in FIGS. 1 to 3 wherein the latch element arm segment 30 extends in generally parallel relation with the base plate 16 of the mounting bracket and the stop arm segment 32 extends generally normal to the base plate of the mounting bracket. The stop arm moves to an active position by pivoting in a clockwise direction from the position shown in FIG. 1 as a result of downward force applied to the arm segment 32 which causes the latch element arm segment to move out of engagement with the retention spring 40 and to an angular relation with the base plate of the mounting bracket. As a result, the arm segment 32 of the stop arm is downwardly-inclined from the position shown in FIG. 1. The arm segment 32 of the stop arm constitutes a foot of the stop arm.

As previously stated, the stop block is the second component of the secondary locking mechanism and is shown in FIGS. 5 and 6. The stop block is in the form of a plate 50 having a pair of openings 52 for receiving fasteners and an inclined end 54 which is at an inclination of a relatively few degrees for the purpose hereinafter described.

The use of the secondary locking mechanism for a patio door is illustrated in FIGS. 7 to 11. A patio door typically has a sill with a track 60. There is at least one fixed door 62 and a sliding door 64. When the sliding door moves to the right, as viewed in FIG. 7, to an open position and as shown by the arrow, the lock 10 is mounted at the bottom of a vertical edge 66 of the sliding door 64. When the sliding door 64 moves to the left in opening movement, as indicated by the arrow in FIG. 8, the lock 10 is mounted adjacent the bottom of a vertical edge 66 of the sliding door 64. In each instance, the lock 10 is mounted on the leading edge of the sliding door to have the stop arm leading in the opening direction.

Figure 9:
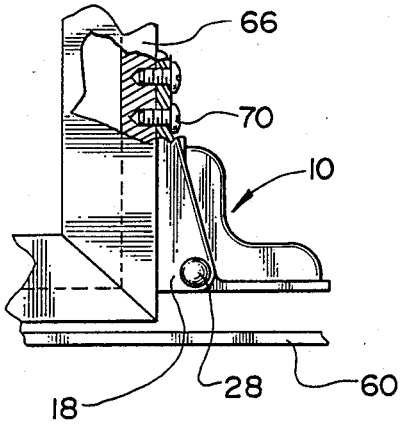
FIG. 9 is a fragmentary view with parts in section showing the lock attachable to a vertical edge of a sliding door near the bottom thereof and the location the relative to a track.
Figure 10:
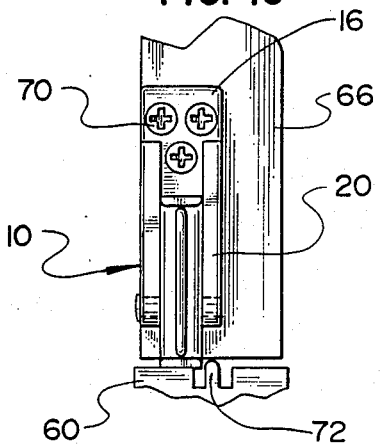
FIG. 10 is a fragmentary view of the structure shown in FIG. 9 looking toward the right side thereof and with a stop arm in active position.

The mounting of the lock 10 to the vertical edge 66 is shown particularly in FIGS. 9 and 10 wherein fasteners 70 extend through the openings 22 in the mounting bracket base plate 16 into the sliding door. The mounting bracket is spaced from the track 60, as shown in FIG. 9. Also, care must be taken to assure that the mounting bracket is not positioned to overlie the main rail 72 of the track 60, with the proper mounting being shown in FIG. 10.

Figure 11:
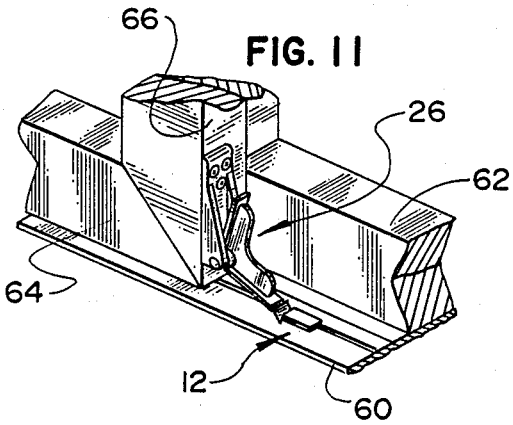
FIG. 11 is a view, similar to FIG. 7 showing the lock in active position and coacting with the floor stop.

The locking action of the secondary locking mechanism is shown in FIG. 11 wherein the stop arm 26 has been pivoted to its active position, with the arm segment 32 defining the foot of the stop arm extending at a downwardly-inclined angle to have a free end thereof at a level below the free end of the inclined end 54 of the stop block 12. The stop block 12 can be referred to as a floor stop in the use thereof with a patio door. In FIG. 11, the free end of the arm segment 32, functioning as a foot, is shown captured beneath the inclined end 54 of the floor stop which precludes movement of the sliding door 64 to the right, as viewed in the Figure. In FIG. 11, the floor stop is positioned to aid in holding the sliding door locked in closed position. It is possible to utilize additional floor stops mounted at different locations along the track 60 whereby the sliding door may be prevented from moving further open from one or more partially-open vent positions.

From the foregoing, it will be noted that the lock 10 must be mounted a certain minimum distance above the track 60 so that the foot portion of the stop arm, when the stop arm is in an inactive position, is free to travel without interference with the stop block (floor stop) 12. This clearance is clearly shown in FIG. 9 while, in FIG. 10, the stop arm is shown in its active position wherein the free end of the foot can rest on the track until it comes into contact with the underside of the inclined end 54 of the floor stop.

As an alternative and equivalent structure, a piece of track could be deflected upwardly to form the floor stop, rather than using the plate 50. Reference to a stop block or floor stop in the claims comprehends such a structure.

It will be evident that the secondary locking mechanism can be used with sliding closures other than the sliding door of a patio door. For example, the secondary locking mechanism can be used with a sliding window, with the lock 10 being mounted in the proper position on the sliding window and the stop block 12 being mounted on an adjacent frame member whereby the stop arm of the lock will contact the stop block when the stop arm is in active position.

I claim:

1. Secondary locking mechanism for a sliding closure movable in a frame comprising, a lock mounted to the sliding closure and a stop block with an inclined end mounted to a sill of said frame, said lock having a mounting bracket, an L-shaped stop arm having an apex and two arm segments generally at right angles to each other, and means for pivotally mounting the stop arm at said apex to the mounting bracket with the stop arm having an inactive position with one arm segment extending substantially parallel to the mounting bracket and an active position wherein said one arm segment is angled away from the mounting bracket, the other arm segment defining a foot which in the active position of the stop arm is at an angle extending downwardly from the pivot mounting at said apex to lie in the path of the inclined end of the stop block.

2. A secondary locking mechanism as defined in claim 1 wherein the stop block inclined end is relatively short and inclined at a small angle to lie out of the path of the bottom edge of the sliding door and the foot when the foot is in inactive position.

3. A secondary locking mechanism as defined in claim 2 wherein the stop arm has a flat end structured to engage under the inclined end of the stop block.

4. A secondary locking mechanism as defined in claim 1 including a spring secured to the mounting bracket for holding the stop arm in said inactive position.

5. A secondary locking mechanism as defined in claim 4 wherein said spring is generally U-shaped and positioned to capture said one arm segment therewithin.

6. A secondary locking mechanism in combination with a sliding patio door movable in a frame having a sill mounting a track comprising, a lock mounted to the lower end of a vertical edge of the sliding patio door and a floor stop with an inclined end mounted to said sill, said lock having a mounting bracket, a generally L-shaped stop arm having an apex and two arm segments generally at right angles to each other, and means for pivotally mounting the stop arm at said apex to the mounting bracket with the stop arm having an inactive position with one arm segment extending substantially parallel to the mounting bracket and the other stop arm segment being a foot which is generally parallel to and spaced above the sill, the stop arm having an active position wherein said one arm segment has been angled away from the mounting bracket and the foot has an end in the path of and below the inclined end of the floor stop.

7. Secondary locking mechanism for a sliding patio door movable in a frame having a sill and enabling locking of the patio door in fully closed or a venting position dependent on the location of a floor stop comprising, a lock mountable to the sliding patio door and a floor stop having an inclined end and mountable to the top surface of said sill, said lock comprising a mounting bracket, a generally L-shaped stop arm having an apex and two arm segments generally at right angles to each other, means for pivotally mounting the stop arm at said apex to the mounting bracket with one of said arm segments extending generally upright alongside the mounting bracket and functioning as a latch element and the other arm segment functioning as a foot and extending outwardly from the mounting bracket generally at right angles thereto, and a retention spring fixed to said mounting bracket, said stop arm having a releasable inactive position with the latch element arm segment releasably held by the retention spring and the foot positioned for depression by a user's foot to pivot the stop arm downwardly to an active position with simultaneous release from the retention spring, and an exposed end of the foot being at a level, when in the active position, to move beneath the inclined end of the floor stop as the patio door is moved a slight distance toward the floor stop.

8. A secondary lock mechanism as defined in claim 7 wherein said latch element arm segment is of a size to extend outwardly of the mounting bracket when the stop arm is in either said active or inactive positions whereby a user's foot can engage said latch element arm segment and pivot the stop arm from an active position to an inactive position with holding thereof in the latter position by the retention spring.

9. A secondary lock mechanism as defined in claim 8 wherein said retention spring is generally U-shaped with a pair of curved sections which releasably engage opposite sides of the latch element arm section when the stop arm is in said inactive position.

* * * * *